US007448178B2

(12) United States Patent
Visone

(10) Patent No.: US 7,448,178 B2
(45) Date of Patent: Nov. 11, 2008

(54) FIELD FABRICATED JOIST HANGER

(76) Inventor: Michael Joseph Visone, 636 Dogwood Ave., Franklin Square, NY (US) 11010-3246

( * ) Notice: Subject to any disclaimer, the term of this patent is extended or adjusted under 35 U.S.C. 154(b) by 200 days.

(21) Appl. No.: 11/208,342

(22) Filed: Aug. 20, 2005

(65) Prior Publication Data

US 2006/0059845 A1 Mar. 23, 2006

Related U.S. Application Data

(60) Provisional application No. 60/609,340, filed on Sep. 14, 2004.

(51) Int. Cl.
*B21C 1/00* (2006.01)
*B21D 13/00* (2006.01)
*E04B 1/38* (2006.01)

(52) U.S. Cl. ..... 52/712; 428/582; 428/603; 428/584; 52/702

(58) Field of Classification Search ..... 52/702, 52/712, 289; 403/190; 428/571, 572, 573, 428/582, 603, 583, 584
See application file for complete search history.

(56) References Cited

U.S. PATENT DOCUMENTS 537,505 A 4/1895 Van Dorn
666,918 A 1/1901 Butz
4,480,941 A 11/1984 Gilb et al.
4,572,695 A * 2/1986 Gilb ..... 403/232.1
4,713,923 A * 12/1987 Sielaff et al. ..... 52/713
5,111,632 A 5/1992 Turner
6,158,931 A 12/2000 Savard
7,007,432 B2 3/2006 Commins
7,021,879 B2 4/2006 Taneichi
2003/0079433 A1 * 5/2003 Leek et al. ..... 52/712
2004/0244328 A1 * 12/2004 Bak et al. ..... 52/712

FOREIGN PATENT DOCUMENTS

WO PCT/US/2006006970 2/2006

OTHER PUBLICATIONS

PCT-written opinion, Mar. 6, 2008, Michael Joseph Visone, pp. 1-5.

* cited by examiner

*Primary Examiner*—Brian Glessner
*Assistant Examiner*—Adriana Figueroa
(74) *Attorney, Agent, or Firm*—Alfred M. Walker

(57) ABSTRACT

A partially manufactured contiguous metal joist hanger is provided for field fabrication into the likeness and function of a contiguous joist hanger of a desired shape. The contiguous metal joist hanger comprises vertical flanged mounting brackets and a horizontal supporting seat positionable integral flange bracket for securing wood framing members at an intersecting joint.

12 Claims, 5 Drawing Sheets

FIG. 9
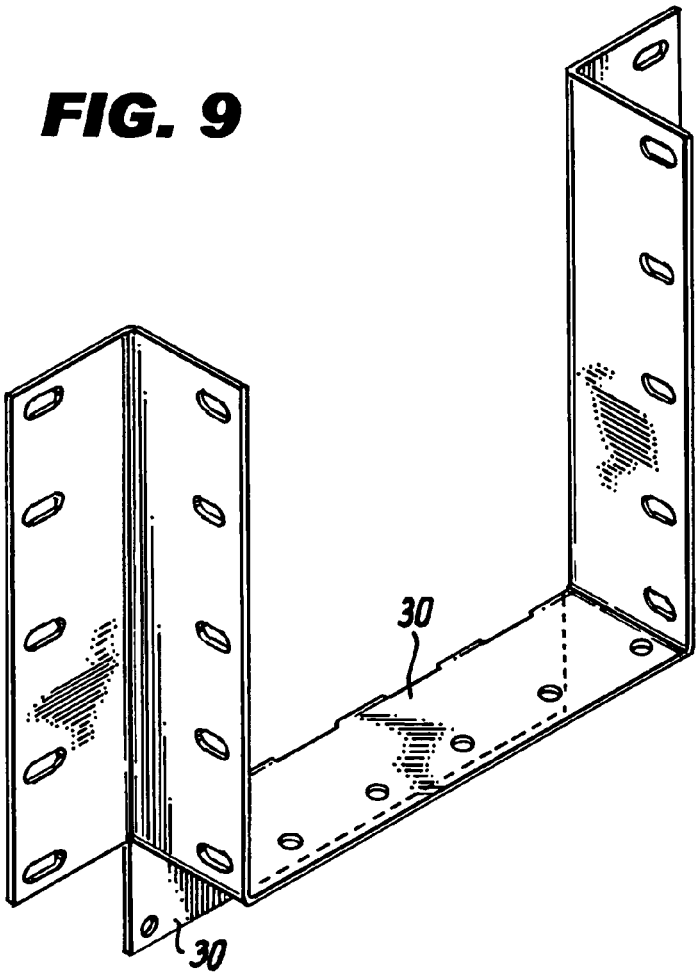
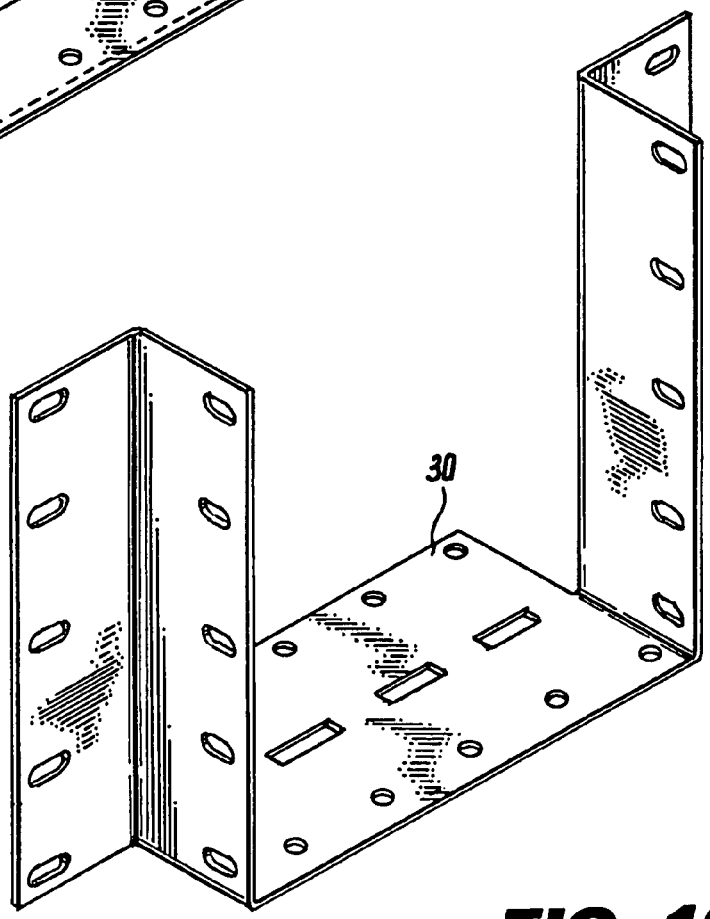
FIG. 10

FIG. 11
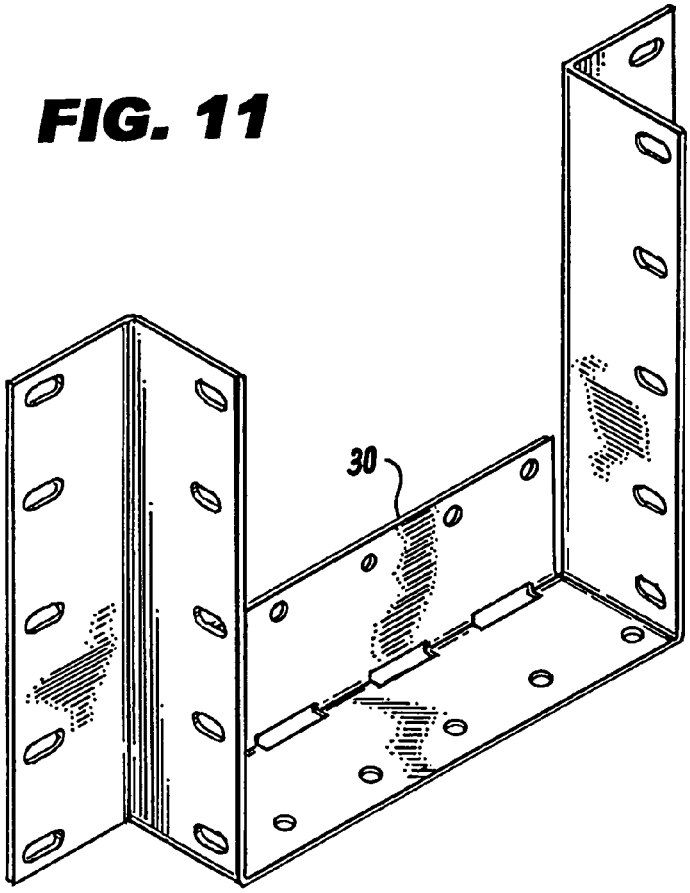
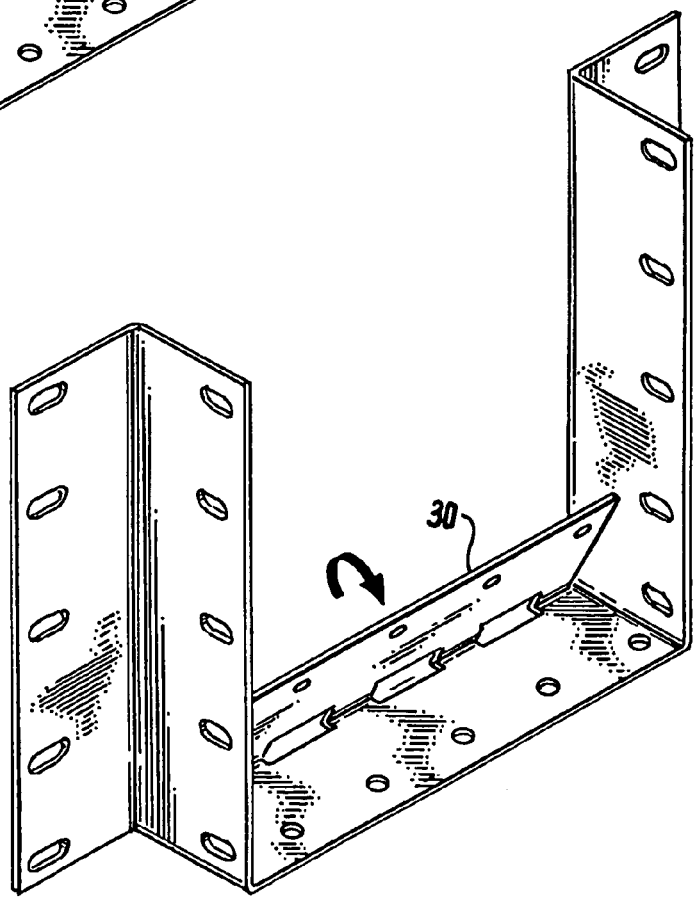
FIG. 12

FIG. 13
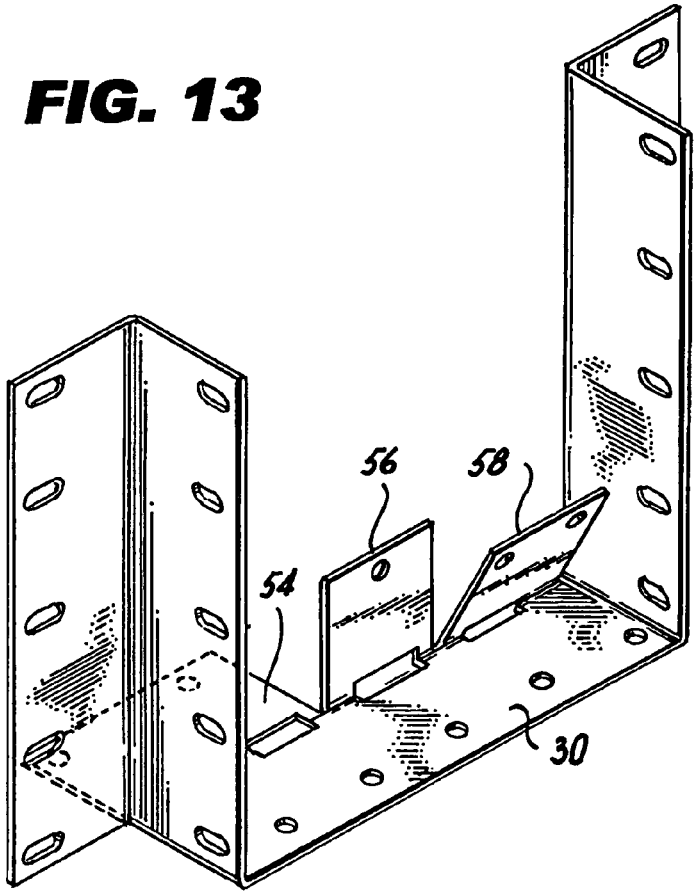
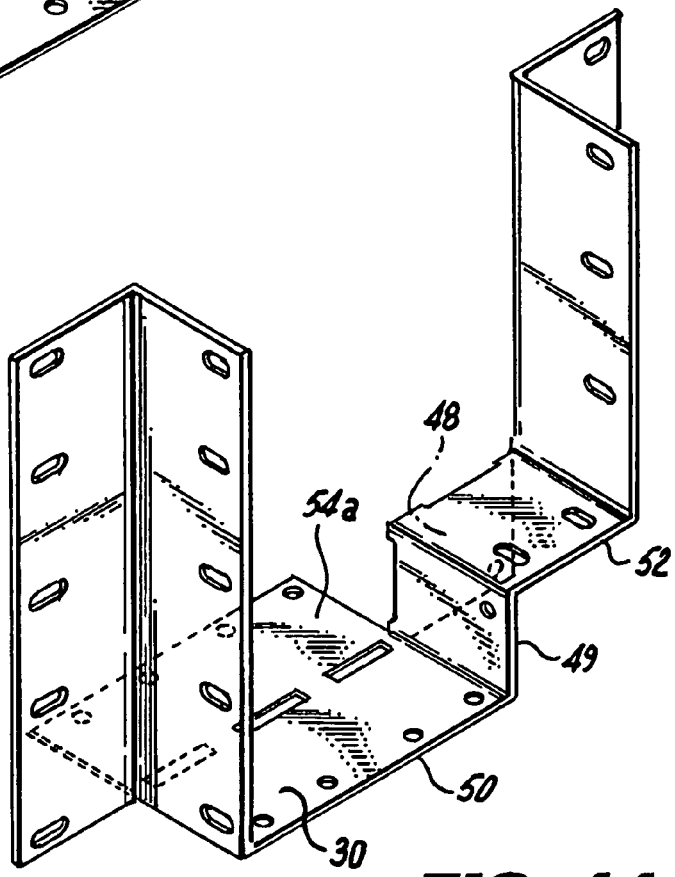
FIG. 14

FIELD FABRICATED JOIST HANGER

CROSS-REFERENCE TO RELATED APPLICATIONS

This application claims the benefit of provisional application Ser. No. 60/609,340 filed 14 Sep. 2004 by the present inventor.

FEDERALLY SPONSORED RESEARCH

Not Applicable

SEQUENCE LISTING OR PROGRAM

Not Applicable

BACKGROUND OF INVENTION

1. Field of Invention

This invention relates to joist hangers.

2. Prior Art

The value of using joist hangers for reinforcement of intersecting framing members has been recognized and accepted for more than 100 years. New building materials are continually being developed and construction methods are likewise adapted to conform to resultant updates in building codes. A relevant adaptation to modern construction methods is the evolution of the joist hanger. Joist hangers are mass-produced, relatively inexpensive, and provide strength for holding framing members together. Joist hangers are made for very narrow and specific applications as the following example illustrates:

Laminated Veneer Lumber, commonly known as LVL, is one type of framing member that was developed as a stronger and more reliable alternative to lumber sawn from trees. LVL is widely used in building construction throughout the world. The term 'LVL' represents any laminated type beam.

The standard width of LVL members is nominally larger than the standard width of tree-sawn lumber. Because of this difference in width, joist hangers manufactured for tree-sawn lumber are not compatible with LVL. The industry responded by providing new joist hanger sizes to accommodate LVL. To further illustrate, joist hangers are mass-produced to accommodate singles or multiples of tree-sawn members of the same width. Similarly, joist hangers are also mass-produced to accommodate singles or multiples of LVL members of the same width. Consequently, joist hangers for tree-sawn lumber, whether singles or multiples, are not interchangeable with joist hangers for LVL and vice versa. As a disadvantage, neither LVL joist hangers nor joist hangers made for tree-sawn lumber are designed to be modified for use beyond that for which they were specifically designed.

The art of building construction sometimes presents problems for which currently available solutions are not cost effective or not efficient or both. One such problem occurs when a joist requires a joist hanger but for a variety of reasons the width of the joist does not conform to standard sizing. Mass-produced joist hangers are designed to fit standard and very specific joist sizes. It is neither practical nor cost effective to produce, joist hangers of an unknown number of in between sizes and therefore in-between size joist hangers are not commercially available.

Modern framing members are available in different types and sizes. These different members are commonly used within a single structure. There are situations where these dissimilar framing members are of necessity used in combination with each other resulting in a finished member that does not conform to standard sizing with regard to commonly available joist hangers. Thus, in-between sized joist hangers are sometimes required however applicant knows of no available product to fill this need.

Other situations are possible that result in the same problem. Framers sometimes introduce various adaptations such as sandwiching a piece of plywood between framing members to increase member strength or other conformity. Another deviation from standard sizing is the introduction of a ledger board of dissimilar size or material to the framing members. Further examples are when joists and/or headers and/or rafters need to be in precise locations in close proximity to each other such that there is inadequate clearance between members to insert and/or fasten separate joist hangers. These are some but not all of the situations where an in-between size or oversize joist hanger is necessarily required but no suitable product is readily available.

The most common solution to the problem of not having a unique size joist hanger is to pay someone to manufacture a custom joist hanger. Purchasing a custom made joist hanger from a fabricator is a time consuming and relatively expensive process. The custom joist hanger must first be designed and then ordered. The fabricator must them form and/or weld a metal piece or pieces. Holes for fasteners must be made in the completed joist hanger. This work is performed manually by a mechanic or by a mechanic operating machinery. The custom made joist hanger must also be delivered to the location where it is needed and then installed. There are some joist hangers such as those made by a steel fabricator that are made from light guage angle steel as opposed to the sheet metal that is commonly used to manufacture mass-produced joist hangers. These heavier guage steel joist hangers require installation with large screws or lag bolts which need pilot holes to be drilled in the framing members for proper installation. The purchaser of the custom joist hanger commonly waits one day or more to get the finished product. The cost of this process substantially exceeds that of a mass-produced joist hanger.

A look at the earlier days of joist hangers reveals in the year 1895 U.S. Pat. No. 537,505 was granted for Van Dorn's joist hanger which is a forerunner of modern joist hangers. Van Dorn's joist hanger is essentially a horizontal shelf or seat supported by opposing vertical flanged side brackets formed as one continuous piece of metal. The supported member is then seated on the horizontal shelf and the opposing side brackets are fastened to the supporting and supported members.

While the essence of Van Dorn's joist hanger has not changed, patents have been granted for varying forms. One such variation is U.S. Pat. No. 4,480,941 November 1984 by Gilb and Commins for the "Double Shear Angled Fastener Sheet Metal Connector". The innovation of 'double shear' applied to a Van Dorn style joist hanger increased the strength and efficiency of the joint held by the improved joist hanger. However neither the Van Dorn design (537,505) nor the Gilb and Commins design (4,480,941) allow the user to vary the joist hanger seat width or utilize the seat as a third fastening bracket to introduce shear strength on the plane of the seat.

Another variation of joist hangers is Turner's "Expandable Joist Hanger" U.S. Pat. No. 5,111,632 May 1992. Turner's patent provides an adjustable seat width joist hanger intending to solve some or all of the problems that are the subject of this application. In all of its described forms Turner's patent provides a non-contiguous unassembled joist hanger that consists of multiple, separate, and distinct metal brackets. These brackets are arranged around the end of a joist in a prescribed fashion and fastened to supported and supporting members. While each individual bracket that makes up Turner's joist hanger is fastened to its respective framing member, the product remains a non-contiguous joist hanger.

By its own definition the Turner joist hanger is slideable and moveable. Its expandability is dependent on the arrangement of individual brackets whose intersection(s) form break-points. The inherent weakness of break-point(s) in the joist hanger leave the Turner disign at a critical disadvantage compared to contiguous joist hangers. This critical disadvantage is manifest as an inability of two or more separate pieces of metal to have the comparable tensile strength of one contiguous piece of similar metal for the purpose of providing a supporting seat or platgorm in a joist hanger application. The ability of a joist hanger seat to carry a load is dependent on the tensile strength of the joist hanger metal. Increasing the tensile strength of the joist hanger increases its resistance to deformity and subsequent failure. The only method known to this applicant to render the Turner joist hanger comparable in tensile strength to a contiguous metal joist hanger is to weld the individual brackets together. This remedy is costly, inefficient, and the quality of the joist hanger is subject to the skills of the welder.

The economic disadvantages of the Turner "Expandable Joist Hanger" are apparent in the amount of effort required to manufacture the individual brackets. To manufacture one joist hanger in each of its 5 different illustrated forms would require 12 unique, non-interchangeable brackets. These 12 brackets must be bent a collective total of 28 times. One of the 12 brackets requires welding. A brief overview of the 5 illustrated forms of Turner's "Expandable Joist Hanger" is as follows:

Slideably Engaged version: This version is the primary embodiment. It is made from 3 brackets requiring a total of 12 bends of which there are 3 different types: 90°, 180°, and offset. This version is the most complicated to manufacture. Contains multiple break-points.

Angularly Adjustable version: This version is made from 3 brackets requiring a total of 2 bends at 90°. The pivot bracket that functions as a seat requires welding. Contains multiple break-points.

Overlay Platform version: This version is made from 2 brackets requiring 5 bends at 90°. One bend is integral to the retention of displaced metal. One bracket requires special slotting to recieve displaced metal from the mating bracket. Contains one break-point.

Adjacent Tongue version: This version is made from 2 brackets requiring 4 bends at 90°. Each bracket requires special slotting to recieve displaced metal from the mating bracket. Contains multiple break-points.

Perpendicular Extension version: This version is made from 2 brackets requiring 5 bends, 4 of which are at 90° and 1 bend is slightly less than 90°. One bracket requires special slotting to recieve the tongue of the mating bracket. Contains one break-point.

The complexity and close tolerances between engageable elements, especially apparent in the primary embodiment, are a burden to manufacturing as each of Turner's multiple brackets requires its own tooling and manufacturing procedure. Comparative to this is classic design joist hanger manufacturing which is fast and efficient in that it comprises one bracket with 4 bends at 90° under one tooling and manufacturing procedure.

Another disadvantage by comparison is time spent on installation. The classic design joist hanger has a simpler and faster installation procedure than the Turner multiple bracket system because no time need be spent on aligning and assembling engageable brackets.

The Turner multiple brackets also present a problem by leaving protruding metal. In the very least, the primary embodiment introduces a safety hazard by leaving a sharp metal corner protruding laterally from each side of the joist hanger. The angularly adjustable version produces two such problems. Sharp metal corners protrude vertically downward below the horizontal plane of the bottom of the joist on each side of the joist hanger. A pivot rod also protrudes laterally from each side of the joist hanger. The overlay platform version leaves a tab of displaced metal protruding below the plane of the bottom of the joist. The adjacent tongue version leaves two problems similar to the angularly adjustable version. Sharp corners are left protruding vertically downward and lateral tongues extend from each side of the joist hanger. The perpendicular extension version requires the deliberate deforming of a protruding part of the bracket that leaves the hazard of an unsecured metal tab. The downward protrusions also present interference regarding interior finishing. Joists are commonly finished with sheetrock and any protrusion into the planar surface, whether large or small, interferes with the sheetrocking procedure.

Further disadvantage is noted in the multiple bracket system itself embodied in all forms of Turner's "Expandable Joist Hanger". Joist hangers are used primarily by carpenters and mechanics who use vans and trucks to transport and store their wares. Any person familiar with contractor vans and box trucks knows that small objects like metal brackets can become lost, scattered, stepped on, and appropriated for things other than intended use. In this way the Turner multiple bracket system can become a nuisance.

There is no joist hanger known to this applicant that combines the tensile strength of a contiguous joist hanger, the versatility of user determinable size, and the efficiency of cost-effective manufacturing. The Turner multiple bracket system lacks critical strength and production efficiency. Classic joist hanger designs offer superior strength and production efficiency. Classic joist hanger designs however fail to provide a means by which to vary joist hanger width, which is the subject of the present application.

OBJECTS OF THE INVENTION

The present application provides a joist hanger that integrates the tensile strength of contiguous metal and the versatility of user determinable width in an efficient and cost effective product. Accordingly, in addition to the objects and advantages of my previous application, some of the objects and advantages of the present invention are as follows:

(a) present invention is made from a single metal blank and retains the benefit of tensile strength of contiguous metal as found in classic joist hanger design over multiple bracket systems;

(b) present invention has the versatility of being able to be fabricated to a desired size by the end user;

(c) present invention is efficient and cost effective in that it requires holing not unlike that of mass-produced joist hangers but contains only one bend at 90° as opposed to multiple bends of mass produced joist hangers;

(d) present invention consumes only slightly more metal than large mass-produced joist hangers and utilizes most or all of the extra metal to increase resistance to deformity over classic joist hanger designs as well as multiple bracket designs;

(e) present invention fabricates quickly and easily using tools commonly found in the construction trade, including but not limited to: tin snips, shears, nibblers, hack saw, jig saw, reciprocating saw, angle grinder, vise, pliers, hand seamers, hammer;

(f) present invention installs in similar fashion to mass-produced joist hangers which is superior to alignment/assembly procedures of multiple bracket systems;

(g) present invention installs in similar fashion to mass-produced joist hangers which is superior to multiple bracket systems that leave hazardous and problematic sharp metal protrusions;

(h) present invention contains a versatile flange that is an integral part of the joist hanger seat. The flange can be used in numerous ways including but not limited to: (1) the flange can remain in place after the joist hanger is set to the desired size. Conditions permitting, the flange is then fastened to the face of the supporting member. The use of this flange in this manner increases the joist hanger's resistance to deformity; (2) the flange can be positioned so as to be on the same general plane as the seat of the joist hanger. Conditions permitting, the flange is then fastened to the horizontal underside of the supporting member. The use of this flange in this manner increases the joist hanger's resistance to deformity; (3) the flange can be positioned so as to be substantially perpendicular to the seat of the joist hanger, such that after installation the flange remains concealed between the end of the supported joist and the vertical face to the supporting member. Conditions permitting, the flange is then fastened to the vertical face to the supporting member. The use of this flange in this manner increases the joist hanger's resistance to deformity; (4) the flange can be positioned so as to be substantially perpendicular to the seat of the joist hanger. Conditions permitting, the flange is first fastened to the underside of the supported sloping member, as in the case of rafters, where the rafters engage the vertical face of the supporting member. The forming of the joist hanger can now be completed by pressing the joist hanger's vertical flanges against the vertical face of the supporting member and fastening accordingly. The use of this flange in this manner increases the joist hanger's resistance to deformity; (5) the flange can be removed if desired;

(i) present invention contains vertical flanges such that the upper portion of which can be: (1) formed into reinforcing straps that can be formed over the top horizontal surfaces of the supported member as well as the supporting member and fastened accordingly. The use of the vertical flanges in this manner increases the joist hanger's resistance to deformity; (2) removed if extending above the top horizontal planar surface of the supported member and supporting member;

(j) present invention is efficient and cost effective in that it is substantially less expensive than purchasing a custom-manufactured joist hanger;

(k) present invention is comprised of an L-shape that renders it highly conducive to efficient packaging, shipping, and storage;

(l) present invention is comprised of an L-shape that has the unintended benefit of being able to be rendered into several smaller general purpose brackets.

Further objects and advantages are to provide a partially manufactured joist hanger that can be adapted to numerous framing needs. For instance it may be desirable to form a joist hanger with two seats or three seats on different horizontal planes as opposed to the classic joist hanger style with only a single seat. The present invention makes it possible to form a stepped-seat joist hanger. A partially manufactured joist hanger does not of necessity mean it must always be used as a joist hanger. It may be desirable to form a bracket that functions on three axes to secure with a contiguous connector two or more aspects of a frame to enhance the structural integrity of the overall frame. The present invention is designed to provide cost-effective solutions and options unavailable up to the present time.

SUMMARY

In accordance with the present invention a field fabricated joist hanger comprises a partially manufactured contiguous joist hanger which contains a continuous flanged metal bracket with a perpendicular bend along the longitudinal dimension, displacement of metal for efficiency, and openings to facilitate forming, angled fastening, and conventional fastening. Forming is accomplished by severing and bending respective flanges to produce a contiguous joist hanger with a seat or seats of desired width, or other useful construction connector.

BRIEF DESCRIPTION OF DRAWINGS

FIG. 9 is a perspective view of a further alternate form for the Field Fabricated Joist Hanger, shown with the parallel joist flange assemblies folded to a perpendicular position with respect to the joist seat, with the integral flange (30) positioned to be face-fastened to the supporting member.

FIG. 10 is a perspective view of a further alternate form for the Field Fabricated Joist Hanger as in FIG. 9, with the integral flange (30) positioned to be fastened to the horizontal underside of the supporting member.

FIG. 11 is a perspective view of a further alternate form for the Field Fabricated Joist Hanger as in FIG. 9, with the integral flange (30) positioned to be face-fastened to the supporting member in a concealed configuration between the end of the supported member and the face of the supporting member.

FIG. 12 is a perspective view of a further alternate form for the Field Fabricated Joist Hanger as in FIG. 9, with the integral flange (30) positioned to be fastened to the sloping underside of a rafter(s).

FIG. 13 is a perspective view of the Field Fabricated Joist Hanger as in FIG. 9, shown with transverse cuts to the integral flange (30) in a split configuration. Part of the transversally cut integral flange (30) forms a subdivision flange (54), which is positioned to be fastened to the horizontal underside of the supporting member. Adjacent subdivision flange (56) formed from the transversally cut integral flange (30) is positioned to be face-fastened to the supporting member. Further subdivision flange (58) formed from the transversally cut integral flange (30) is positioned to be fastened to the sloping underside of a rafter(s).

FIG. 14 is a perspective view of the Field Fabricated Joist Hanger of FIG. 9, shown with multiple joist seats on different horizontal planes. Part of the integral subdivision flange (54*a*) formed from the transversally cut integral flange (30) is positioned to be fastened to the horizontal underside of the supporting member in tandem with the lower seat (50). The remaining part to the integral subdivision flange (48) is positioned to be face-fastened to the supporting member below the upper seat (52).

DESCRIPTION OF THE PREFERRED EMBODIMENT

Figure 1:
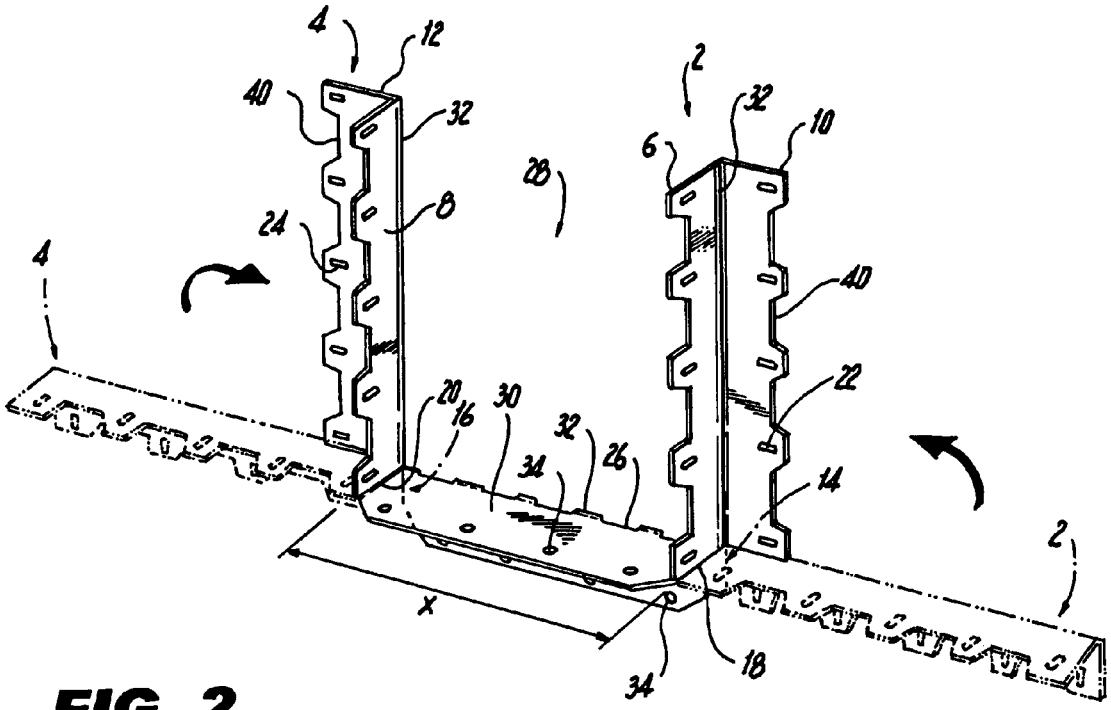
FIG. 1 is a perspective view of the connector of the present invention, the Field Fabricated Joist Hanger, shown in initial stages of vertical bending and forward longitudinal bending, along the directional arrows as shown.
Figure 2:
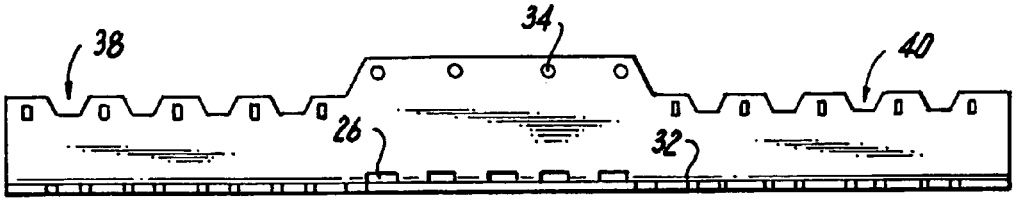
FIG. 2 is a front elevation view of the connector of FIG. 1, the Field Fabricated Joist Hanger, with a factory-made bend (32) showing the rear half of the connector extending vertically upward along a longitudinal axis.
Figure 3:
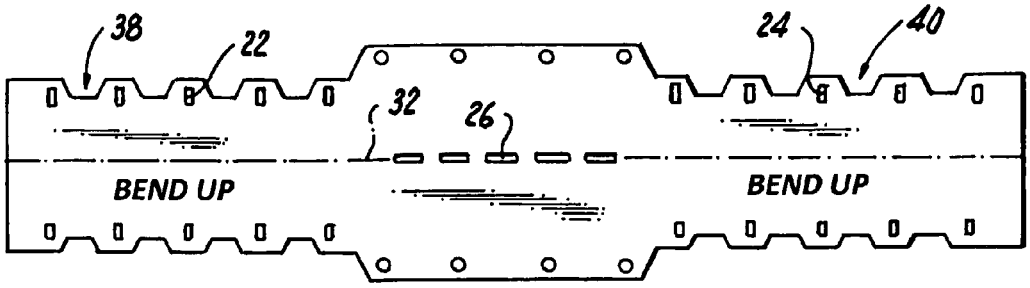
FIG. 3 is a top plan view of the connector of FIG. 1, the Field Fabricated Joist Hanger, shown in a flat, unbent position prior to longitudinal factory-bending.
Figure 4:
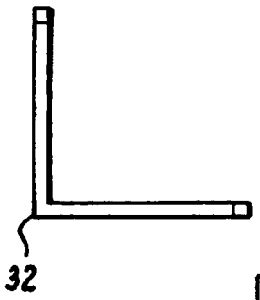
FIG. 4 is a side end view of the Field Fabricated Joist Hanger shown with the longitudinal factory-made bend (32) position as in FIG. 2.

The preferred embodiment of the present invention is illustrated in FIG. 1. For illustration purposes FIG. 1 is shown with the flanged brackets fully formed into the customary perpendicular placement with respect to the joist hanger seat. The partially manufactured joist hanger is adequately symmetrical in design such that either flange can be chosen for severing and respective bending. The partially manufactured joist hanger has one substantially perpendicular bend (32) along the longitudinal dimension which forms the basis of the flanged brackets (2,4). Each of the brackets contains a supporting member mounting flange (10,12) and a supported member mounting flange (6,8). Dimension 'X' represents the width of the joist hanger seat and is determined by the placement of cuts (14,16) through one flange and terminating at the perpendicular bend (32). After locating cuts at (14,16), corresponding right-angle bends (18,20) are made in the uncut flange resulting in creation of the joist seat (28). The flanged brackets (2,4) can be formed such that the supporting member flanges (10,12) are concealed between the supported joist vertical end and the supporting member face; or the brackets (2,4) can be formed such that the supporting member flanges (10,12) extend outward and away from the supported joist.

After forming the partially manufactured joist hanger to the desired width, the integral perpendicular flange (30) attached to the seat (28) is configured to satisfy the requirement of the application. Use of the integral flange (30) is the preferred method of mounting the completed hanger however this flange can be removed. The integral flange adds strength and can be used in a variety of ways. Manipulation of the flange is made easy via the forming slots (26) provided. As requirements apply, the integral flange (30) is designed to be used in the following ways: (a) the integral flange can remain in its manufactured position in whole or part and be face-fastened to the supporting member; (b) the integral flange can be positioned in whole or part to facilitate mounting to the horizontal underside of the supporting member; (c) the integral flange can be positioned in whole or part and face-fastened to the supporting member such that the flange remains concealed between the end of the supported joist and the face to the supporting member; (d) the integral flange can be positioned in whole or part to facilitate mounting to the angled underside of a rafter or rafters whether the joist hanger is used solely for a rafter application or where rafters are used in conjunction or combination with a joist or joists.

Fastener holes (34,36) are provided in the seat (28) and integral flange (30) and their use is dictated as conditions require. Elongated holes (22,24) are provided to facilitate angled fastening. Extraneous metal (38,40) is removed during manufacturing to reduce weight and conserve material.

Figure 5:
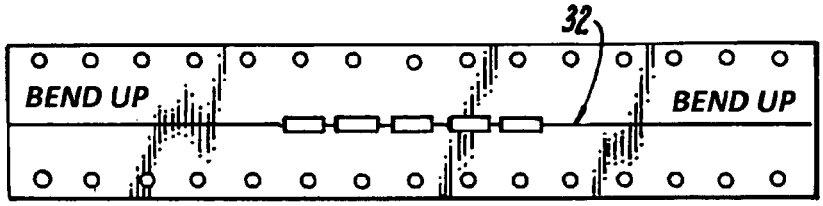
FIG. 5 is a top plan view of an alternative form of the Field Fabricated Joist Hanger shown in a flat, unbent position prior to longitudinal factory-bending.
Figure 6:
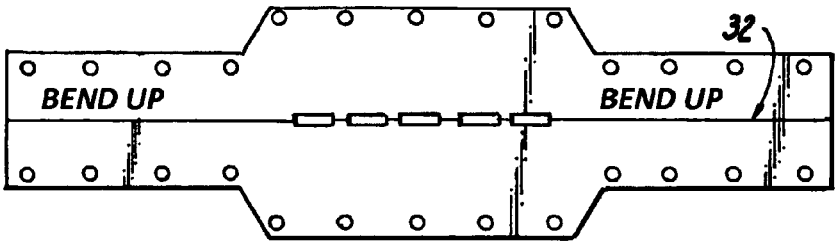
FIG. 6 is a top plan view of an alternative form of the Field Fabricated Joist Hanger shown in a flat, unbent position prior to longitudinal factory-bending.
Figure 7:
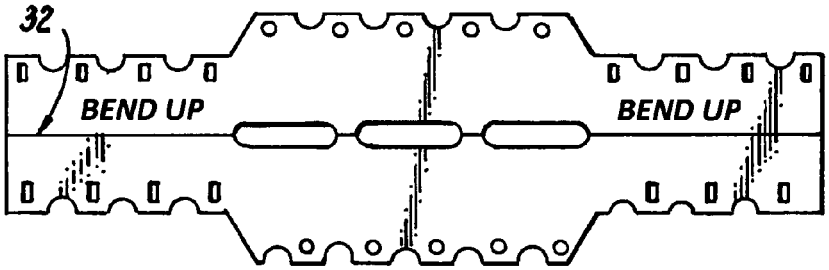
FIG. 7 is a top plan view of an alternative form of the Field Fabricated Joist Hanger shown in a flat, unbent position prior to longitudinal factory-bending.
Figure 8:
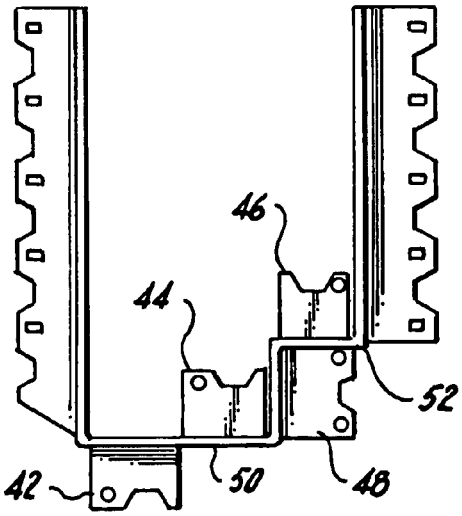
FIG. 8 is a front elevation view of the Field Fabricated Joist Hanger in a multiple seat joist hanger configuration shown in a bent position of use.

FIG. 5, FIG. 6, and FIG. 7 represent a few of the possible alternative designs in top plan view. FIG. 8 represents one of the unique design aspects of the present invention. The partially manufactured joist hanger can be configured to form a stepped-seat joist hanger with two or more seats on different respective horizontal planes. In FIG. 8 and in similar applications the integral flange can be used in many combinations simultaneously. By making appropriate cuts and bends based on the application, the integral flange can be: face-fastened to the supporting member in multiple places (42,44,48) from different planes; horizontally mounted to the underside of a supporting member; angle mounted (46) to the sloping underside of a rafter or rafters. Lower seat (50) is secured via subdividing the integral flange and offset-mounting flanges (42,44). The upper seat (52) is secured to the sloping underside of a rafter or rafters via subdivision of flange (46). The vertical flange assembly (48) connects the lower seat (50) and the upper seat (52) and is face-fastened to the supporting member. This method of subdividing the integral flange simultaneously introduces additional interlocked shear planes on three axes particularly regarding the seat area. The joist hanger seat or seats configurations benefits from the resistance of fastened contiguous joist hanger metal to horizontal forces, vertical forces, and angled forces simultaneously, thereby providing overall increased resistance to joist hanger deformity and subsequent failure. The seats of conventional joist hangers in use today are suspended from above by vertical flanged fastening brackets. This can result in as much as one-third of a large joist hanger's supported member fastening flange area not being utilized to secure contiguous metal directly to the supporting member. The present invention provides a means by which contiguous joist hanger metal can be extended onto the fastening planes of supporting members. Applicant knows of no other contiguous metal design that provide so the versatility of custom sizing or multiple seat configuration or interlocking shear planes of the fastened joist hanger seat configuration.

FIG. 9 is a perspective view of an alternate form of the joist hanger of the present invention, shown with parallel joist flange assemblies bent perpendicular to the joist seat. The integral flange (30) is left in its original factory manufactured position bent longitudinally downward. This configuration is used if sufficient fastening area is available on the face of the supporting member. In large joist hangers this configuration can increase the fastened area of a supported member by 50% or more. The integral flange (30) converts the suspended seat into a fastening flange that increases the resistance to lateral thrust, downward thrust and uplift forces. The benefit of using the integral flange to transform an ordinary joist seat into an additional fastening flange cannot be overstated because commonly available joist hangers do not possess this feature.

FIG. 10 is a perspective view of an alternate form of the joist hanger of the present invention as in FIG. 9. The integral flange is bent as required from its original right-angle factory manufactured position so as to be on the same general plane as the joist seat for the purpose of mounting to the horizontal underside of the supporting member. In this configuration the continuous metal of the joist seat extends across the break between supporting member and supported member. The integral flange (30) converts the suspended seat into a fastening flange that increases the joist hanger's resistance to the forces of lateral thrust, downward thrust, and uplift forces. The benefit of using the integral flange to bridge the natural break that exists between the vertical end of the supported member and the vertical face of the supporting member cannot be overstated because commonly available joist hangers do not possess this feature.

FIG. 11 is a perspective view of an alternate form of the present invention as in FIG. 9. After the vertical legs are formed as in FIG. 9, the integral flange (30) is bent from its original right-angle factory manufactured position approximately 180 degrees for the purpose of fastening to the face of the supporting member where it is concealed between the joist end and the face of the supporting member. In large joist hangers this configuration can increase the fastened area of a supported member by 50%. The integral flange (30) converts the suspended seat into a fastening flange that increases the resistance to lateral thrust, downward thrust, and uplift forces. The benefit of using the integral flange to transform an ordinary joist seat into an additional fastening flange cannot be overstated because commonly available joist hangers do not possess this feature.

FIG. 12 is a perspective view of an alternate form of the present invention as in FIG. 9. The integral flange (30) is bent from its original right-angle factory-manufactured position along the direction of the arrow for fastening to the sloping underside of a rafter or rafters. Angling of the integral flange (30) with respect to the horizontal joist hanger seat introduces joist hanger metal and fasteners on a non-vertical and non-horizontal resultant shear plane to increase resistance to lateral thrust, downward thrust, and uplift forces. The benefit of using the integral flange to transform an ordinary joist seat into an additional fastening flange cannot be overstated because commonly available joist hangers do not possess this feature.

FIG. 13 is a perspective view of the joist hanger of an alternate form of the present invention as in FIG. 9. The integral flange is transversally cut and subdivided into three smaller flanges (54), (56), and (58) that function on three individual planes. The joist seat is thus held secure on three distinct planes. Flange of horizontal subdivision (54) is bent approximately at a right angle from the original factory manufactured position so as to be on the same general plane as the joist hanger seat for the purpose of fastening to the underside of the supporting member. Flange of vertical subdivision (56) is bent approximately 180 degrees from the original factory manufactured position for the purpose of fastening to the face of the supporting member where it is concealed between the joist end and the face of the supporting member, providing resistance to lateral thrust, downward thrust, and uplift forces. Flange of angled subdivision (58) is bent as required from its original factory manufactured position for the purpose of fastening to the sloping underside of a rafter of rafters and provides resistance to lateral thrust, downward thrust, and uplift forces. This combination of subdivision flanges (54), (56), and (58), with the remaining uncut portion of integral flange (30) which comprises the joist seat or seats, form interlocking shear planes that resist forces simultaneously from the horizontal plane, the vertical plane, and an angled plane or planes. Instead of the joist seat being something suspended by a pair of vertical flanged brackets, the joist seat of the present invention becomes a third fastening flange. This third fastening flange secures together through contiguous joist hanger metal the fastening planes of the horizontal underside of the supported member across the perpendicular vertical plane where the members are joined, to the horizontal underside of the supporting member, the vertical face to the supporting member, and the angled underside of the supported member. The benefit of using the integral flange to transform an ordinary joist seat into an additional fastening flange cannot be overstated because commonly available joist hangers do not possess this feature.

FIG. 14 is a perspective view of the joist hanger of an alternate form of the present invention as in FIG. 9. The integral flange (30) is transversally cut and is formed into two seats comprising five fastening flanges. The lower seat (50) is contiguously joined to the supporting member horizontal underside mounting flange (54*a*) providing additional resistance to lateral thrust, downward thrust, and uplift forces. The lower seat (50) is also contiguously joined to the upper seat (52) via the vertical flanged bracket formed by supporting member fastening flange (48) and supported member fastening flange (49). The joist seats now form a bracket that is simultaneously fastened on interlocking shear planes that render the lower seat (50), the upper seat (52), and the overall joist hanger an increased structural integrity from an area not taken advantage of until the present invention. The benefit of using the integral flange to bridge the natural break that exists between the vertical end of the supported member and the vertical face of the supporting member cannot be overstated because commonly available joist hangers do not possess this feature.

Joist hangers commonly available today do not bridge the gap between structural members in the manner previously illustrated. This unbridged gap is a failure to address an inherent weakness, as a significant component of the joist hanger, specifically the seat, is left unsecured on the horizontal plane across the break between supported member and supporting member.

The partially manufactured joist hanger of the present invention lends itself to efficient progressive manufacturing techniques relative to metal connectors with multiple and sometimes intricate bends and forming requirements. The present invention comprises a single flat rectangular sheet-metal blank that is holed, slotted, and voided of extraneous metal; and a single perpendicular bend proximally centered along the longitudinal dimension of the blank. Incremental markings perpendicular to the longitudinal dimension are utilized as an aid to convenient forming of a finished joist hanger (these markings were omitted from FIG. 1 through FIG. 14 for illustration clarity). The versatility of the present invention is also manifest in that a novice carpenter or mechanic can fabricate a custom joist hanger with minimal instruction and practice, while an accomplished carpenter or mechanic can fabricate a vast array of joist hangers and unique and useful construction connectors limited only by the mechanical skills and ingenuity of the user.

Although the previous descriptions contain many specific references, these should not be construed as limiting the scope of the invention but as merely providing illustrations of some of the presently preferred embodiments of this invention. For example, the fastener holes and slots could have other shapes or designs. Extraneous metal can be removed in a variety of ways other than what has been illustrated here. The dimensions of,the rectangular blank and the thickness of the sheetmetal that the blank is made from can also be modified. Thus the scope of the invention should be determined by the appended claims and their legal equivalents, rather than by the examples given.

The claims defining the present invention are as follows; I claim:

1. A blank for a field fabricated metal joist hanger comprising:

a continuous metal connector having a defined central seat without a transverse bend or a transverse severing line and a pair of oppositely lengthwise extending flanges, said central seat being wider than said flanges;

a single bend line proximally centered along a longitudinal dimension of said blank passing centrally through said seat and flanges;

spaced elongated slots along said single bend only within said seat;

each flange capable of being bent and severed at right angles to and away, respectively, from opposite sides of said seat along a bending/severing line adjoining said seat allowing either or both of said flanges to be partially severed and bent with respect to said seat to form a contiguous U-shaped metal joist hanger, whereby said blank has only a single bend along a full length thereof.

2. A blank for a field fabricated metal joist hanger comprising:

a continuous elongated flat rectangular sheet metal connector blank having a defined joist seat without a transverse bend or a transverse severing line and a pair of oppositely lengthwise extending flanges;

a single bend line proximally centered along a longitudinal dimension of said blank passing centrally through said seat and flanges;

spaced elongated slots along said single bend only within said seat;

a rear portion of said joist seat being foldable along said bend to form an integral flange;

each flange capable of being bent and severed at right angles to and away, respectively, from opposite sides of said seat along a bending/severing line adjoining said seat allowing either or both of said flanges to be partially severed and bent with respect to said seat to form a contiguous U-shaped metal joist hanger, whereby said blank has only a single bend along a full length thereof.

3. The joist hanger as in claim 2 wherein a rear portion of said joist seat is foldable flat along the said longitudinal bend to approximately the same plane as the joist seat to be fastened to a horizontal underside of a supporting member.

4. The joist hanger as in claim 2 wherein a rear portion of said joist seat is foldable vertically along said longitudinal bend line to be face-fastened to a supporting member.

5. The joist hanger as in claim 2 wherein said rear portion of said joist seat is foldable along said longitudinal bend line in an angled orientation for attachment to an underside of a rafter or rafters.

6. The joist hanger as in claim 2 wherein said rear portion of said joist seat is left in its manufactured position for mounting to a face of a supporting member.

7. The joist hanger of claim 2 in which said blank further comprises holes.

8. The joist hanger of claim 2 in which said joist seat has a front edge which extends beyond respective front edges of said flanges.

9. The joist hanger of claim 2 in which said joist seat has a rear edge which extends beyond rear edges of said flanges.

10. The joist hanger of claim 2 in which said blank is symmetrical in design such that either flange of said joist seat on opposite sides of said longitudinal bend line can be severed or bent.

11. The joist hanger of claim 2 in which said joist seat is adapted to be used as a third flange in addition to said pair of flanges, to provide shear strength across a joint formed between said pair of flanges, said first flange, said second flange and third flange supporting supported members therebetween.

12. The joist hanger of claim 2 in which said joist hanger offers the options of being formed into a form consisting of the group of a conventional-seat joist hanger; a multiple-seat joist hanger; a joist hanger containing a multiple-use integral flange; or connector of desired width and/or shape by the end-user with basic hand tools including tin snips and plier-type hand bender/seamer.

* * * * *